United States Patent [19]

Csapody et al.

[11] Patent Number: 4,459,509

[45] Date of Patent: Jul. 10, 1984

[54] DISCHARGE VESSEL FOR HIGH PRESSURE SODIUM VAPOR LAMPS

[75] Inventors: Miklós Csapody; Endre Oldal, both of Budapest, Hungary

[73] Assignee: Egyesult Izzolampa es Villamossagi RT., Budapest, Hungary

[21] Appl. No.: 337,695

[22] Filed: Jan. 7, 1982

[30] Foreign Application Priority Data

Jan. 9, 1981 [HU] Hungary ..... 47

[51] Int. Cl.[3] ..... H01J 61/20; H01J 61/22; H01J 61/36

[52] U.S. Cl. ..... 313/565; 313/625

[58] Field of Search ..... 313/571, 623, 625, , 313/634, 565, 566, 318, 624

[56] References Cited

U.S. PATENT DOCUMENTS 4,065,691 12/1977 McVey ..... 313/565

4,376,905 3/1983 Kerekes ..... 313/623 X

*Primary Examiner*—Palmer C. Demeo

*Assistant Examiner*—Sandra L. O'Shea

*Attorney, Agent, or Firm*—Anthony H. Handal

[57] ABSTRACT

A tubular discharge vessel for high pressure sodium vapor lamps has a wall 1 made of light-transmitting material. The tube 1 is hermetically sealed at each end by a respective ceramic stopper 2 through which is passed a respective current lead-in wire 11. An electrode 8 is joined via a shank 10 to the current lead-in wire 11. The interior of the tube is filled with noble gas(es) and metal additive(s), e.g. sodium, mercury and/or cadmium. A cavity 9, preferably of rotationally symmetrical shape is formed in at least one of the stoppers 2. In operation of the discharge tube the cavity 9 is the cold spot. i.e. the internal wall of the lowest temperature. The volume of the cavity 9 is at least equal to the volume of the metal additives in their liquid phase. In this way, in operation of the tube, the metal additives always condense in the cavity, the vitreous enamel bonds between the tube wall and the stoppers are free from chemically aggressive effects and whereby the self-stabilizing thermal processes taking place in the discharge vessel are promoted.

5 Claims, 1 Drawing Figure

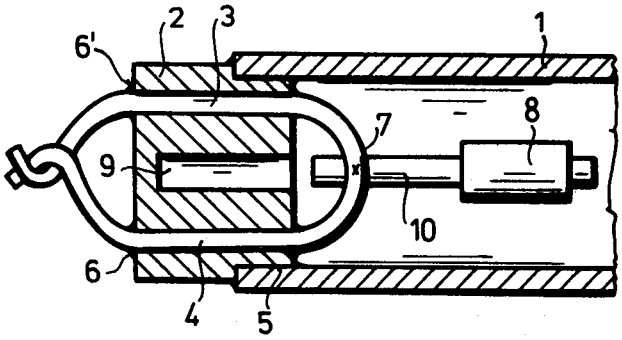
2
3
1
6'
8
7
9
10
6
4
5

DISCHARGE VESSEL FOR HIGH PRESSURE SODIUM VAPOR LAMPS

FIELD AND BACKGROUND OF THE INVENTION

The invention concerns a discharge vessel for high pressure sodium vapour lamps, comprising a tubular wall made of light-transmitting material, two closing elements provided with stoppers, preferably of ceramic material, for hermetically sealing the ends of the tube by means of a bond without the use of an exhaust tube, a current lead-in wire with hermetically sealed entry into the discharge tube and an electrode joined, preferably via a stem, to the current lead-in wire and filling in the interior of the sealed tube containing a noble or inert gas and metal additive(s), preferably sodium, mercury and/or cadmium. The discharge vessel according to the invention is intended to be used as a component of high-efficiency, high-pressure sodium vapour lamps applicable in the widest variety of lighting applications, which can assure, even when employing structural materials of poorer quality are used and less careful preparation and manufacture, long service life, uniformity of parameters and reliability for such lamps.

In the manufacturing process of the tubular discharge vessels for high pressure sodium vapour lamps the two ends of the transparent or translucent tube are hermetically sealed by means of closing elements provided with stoppers. A current lead-wire is vacuum-tightly embedded in the stopper and is connected to an electrode arranged in the interior of the tube. The basic material of the tube is alumina; a part of the stopper may also be made of alumina but may additionally contain metallic parts. The components made of alumina oxide and the metallic components of the electric lead-in wires are generally bonded by vitreous enamels of high melting point, which are also suitable for producing a hermetic closure. A fill of noble gas and suitable metal additive(s), particularly sodium, mercury and/or cadmium, are passed into the interior of the tube.

When high pressure sodium vapour lamps comprising gas discharge tubes are activated by applying the required voltage to the electrode, an arc discharge occurs through the noble gas, and the supply voltage and the circuitry (in the simplest form, a choke coil) connected in series with the lamp generates a self-sustaining arc which engenders an increase of the vapour pressure of the metallic additive(s) in the discharge vessel (i.e. sodium, as well as mercury and/or cadmium) and thereby an increase of the operating voltage of the discharge. This process continues until an equilibrium sets in. In this equilibrium of the discharge, the metallic additive(s) are transformed into a liquid phase and their total vapour pressure is of the order of magnitude of $10^5$ Pa, depending on the composition of the melt of the metal additives in the discharge tube and on the value of the lowest surface temperature of the additives. For given dimensions and geometry of the discharge vessel, the ambient temperature, the series circuitry and the supply voltage, the electrical and optical parameters of the discharge are predominantly determined by the partial pressure(s) of the metal additive(s).

In the manufacturing process of discharge vessels for high pressure sodium vapour lamps there are two known methods for bringing the filling material into the discharge tube and for sealing the tube.

Among others, U.S. Pat. No. 3,243,635 and British Pat. No. 1,065,023 describe a method for the production of a discharge vessel, wherein an exhaust tube is used. As a first step of the process an intermediate product is created, wherein the interior of the discharge vessel and the ambient environment communicate via a thin-walled metallic tube known as the exhaust tube (usually made of niobium or a niobium alloy) connected into the stopper of the tube and having a coefficient of thermal expansion approximately matching that of alumina. The discharge vessel is evacuated through the metallic exhaust tube, thereafter the necessary filling is introduced into the interior of the discharge vessel through the same metallic exhaust tube and then the outer end of the exhaust tube is hermetically sealed. In the discharge vessel produced in this way, the tip or stump of the sealed metal exhaust tube becomes both the part for the current lead-in and the part of the discharge vessel which has the lowest temperature, i.e. it forms a so-called 'cold spot' of the discharge tube. The metal additives collect here during operation of the lamp.

The manufacture of discharge vessels with exhaust tubes is relatively expensive requiring complicated special purpose machinery and the use of an exhaust tube renders the conditions for mass-production more difficult.

To simplify the manufacturing process, discharge vessels without exhaust tube have been developed, wherein the introduction of the filling and the sealing of the discharge tube are achieved by other methods. One of the ends of the discharge tube is provided with an electric current lead-in wire and is hermetically sealed by a stopper. Thereafter the discharge vessel is turned over in such a way that its closed end points downwards, the metal additives are filled into the tube via the open top end of the tube and then the closing components are placed into the top end of the tube. This is followed by distributing the basic materials of a vitreous enamel over the closing elements in a quantity and arrangement which after fusion enables the vitreous enamel to flow into any gaps that are still open. Hereafter the whole assembly, or a plurality of assemblies simultaneously is (are) placed into a suitable chamber and their upper end is heated while the lower, closed end (where, due to gravity, the metal additives accumulate) is kept at a temperature low enough for the vapour pressure of the metal additives to be negligible. The chamber is first evacuated then filled with the atmosphere of noble (inert) gas that is desired for the finished discharge vessel. Since at this stage the upper end of the discharge vessel has not yet been sealed hermetically, the pressure and composition of the gas in the inner space of the vessel will be the same as in the chamber. As the next step, the temperature is increased until the molten vitreous enamel flows into fissures or gaps and while the temperature is lowered the upper end of the tube is hermetically closed. The quantity of the gas filled into the discharge vessel is controlled by the gas pressure in the chamber.

There are several known versions of the system without exhaust tube, differing mainly in the manner of forming the current lead-in: thus e.g. according to German Pat. No. 1,639,086 the current lead-in is a niobium tube whose inner end is closed; while according to U.S. Pat. No. 3,693,007 the current lead-in is formed by a metallic layer deposited on the surface of a ceramic stopper, while according to U.S. Pat. No. 4,376,905 it is formed possibly by a plurality of niobium wires in electrically parallel connection.

It is a common constructional feature of the hitherto known exhaust tubeless systems that the previously mentioned 'cold spot', and thus also the melt of the metal additives is located on the wall of the discharge vessel during the operation of the lamp and in general at a spot which during sealing is covered by the vitreous enamel.

According to experience the exhaust tubeless systems make it possible to manufacture in a simple, reliable and economic manner and are therefore widely applied. However, if the materials used in the manufacture as well as the preparative and production processes are not kept under the most severe control, it may happen that the initial dispersion and stability of the electric and optical parameters and the ratio of 'early failure lamps' to the lamps of average longevity increases to an undesirably large extent.

The starting point of the invention is the surmise that these undesirable phenomena are connected with the above-mentioned structural features, of the exhaust tubeless systems, i.e. with the position of the cold spot and of the melt, which in turn may be the result of two kinds of mechanism or phenomena.

One of the mechanisms originates from the direct contact between the vitreous enamel and the melt of the metal additives. It is known that the vitreous enamels applied for sealing the tubes are highly hygroscopic and (chemically) basic, hence they are extremely sensitive to humidity, to carbon dioxide or the presence of other impurities in the environment during production. It appears that the resistance of the vitreous enamel against chemical aggression by sodium is substantially reduced by the slightest degree of contamination and this reduction of resistance is much more pronounced in the case of sodium present in the melt than sodium vapour. Due to the chemical reaction between the molten sodium and the vitreous enamel, the composition of the melt is changed and the properties of the vitreous enamel are also changed, i.e. light transparency, stability, thermal expansion, etc. Naturally these factors considerably affect the properties of discharge vessels and thus of lamps.

The other mechanism is also a consequence of the common constructional features of the hitherto known exhaust tubeless systems, namely that there is a poor heat contact or heat transmission between the cold spot and the adjacent electrode, relative to systems employing exhaust tubes. In systems using exhaust tubes the temperature of the cold spot is mainly determined by the temperature of the electrodes (assuming a given geometry of construction and conditions of external heat transfer) and the temperature of the electrodes, in turn, decisively depends on the characteristics of the arc discharge such as the temperature distribution and the spread. If e.g. the work function of the electrode changes, say increases, this demands an attendant increase of the distribution and/or extent of the arc in order to attain the required ion emission required for the arc discharge, which in turn again automatically increases the ion bombardment hitting the cathode. The necessary consequence of this is a rise in the temperature of the cold spot and thus an increase in the vapour pressure of the metal additives. Due to the increase of the vapour pressure, the operating (ignition) voltage will be increased (the characteristic curve of the arc discharge is shifted) and a higher proportion of the supply voltage, (which is constant) is used up by the discharge vessel and a lower proportion for the circuitry. Therefore, although the power input increases the current demand of the arc discharge will decrease, which means that a self-weakening negative feedback process develops.

This negative feedback is present also in the known exhaust-tubeless systems but, due to the above-mentioned feeble heat contact between the cold spot and the adjacent electrode, to a much lesser extent. However, another feedback effect becomes more appreciable, i.e. the dependence of the temperature of the cold spot on the temperature of discharge-plasma. This is because in these systems the cold spot 'sees' the discharge emitted energy of which directly heats the surface of the melt of the metal additives. If we now surmise again that the work function of the electrode or for any other reason the ignition voltage of the discharge vessel increases, the energy input required by, and thus correpondingly emitted output of, the plasma will also increase. Due to the heat transfer by radiation between the plasma and the surface of the melt of the metal additives the vapour pressure will be increased, whereby the ignition voltage will be further increased. It is apparent, that this process is essentially a positive feedback.

The relative 'weight' of the two kinds—negative and positive—of feedback depends on the extent of the influence exerted by the temperature of the electrode and of the plasma on the temperature of the melt of the metal additives. Since the heat-contact between the cold spot and the electrode is particularly weak in exhaust-tubeless systems using a niobium wire current lead, the positive feedback process becomes predominant. It is, therefore, evident that the effect of the positive feedback is gradually to amplify any kind of instability arising in the discharge vessel.

SUMMARY OF THE INVENTION

The aim of the invention is to provide a discharge vessel for use with high pressure sodium vapour lamps which eliminates or reduces the above-described unfavourable characteristics of discharge vessels without exhaust tube.

According to the invention, this objective is sought to be achieved by the development and application of a tubular discharge vessel having a wall made of a light-transmitting material, two closing elements fitted with stoppers made preferably of ceramic material for hermetically sealing the two ends of the tubular discharge vessel without using an exhaust tube, current lead-in conductors introduced through a hermetic closure into the discharge vessel, an electrode joined to the current lead-in wires preferably via a stem or shank and a filling of the interior of the discharge vessel composed of inert or noble gas(es) and metal additive(s), preferably sodium, mercury and/or cadmium; and according to the invention, at least one of the stoppers contains a cavity which communicates with the interior of the discharge tube and which during operation contains the coldest spot of the surface of the tube defining the boundary of the interior of the discharge vessel, the volume of the cavity being equal to or larger than the volume of the melt of the metal additives. In this way, in operation of the discharge vessel the wall of the cavity formed in the suitable closing member of the discharge vessel constitutes a zone of lowest temperature of the discharge vessel, whereby to improve the conditions of operation, to improve the stability and controlability of the parameters of the discharge vessel. The cavity can be produced as a cylindrical groove or slot or as an annular blind-hole worked expediently into the closing element, symmetrical to the axis line of the tube.

BRIEF DESCRIPTION OF THE DRAWINGS

The invention is further described, merely by way of example, with reference to a preferred embodiment illustrated in the accompanying purely schematic drawing, wherein:

The single FIGURE illustrating a preferred embodiment according to the invention, and The single FIGURE shows a diagrammatic section of one of the ends of a preferred embodiment of a discharge vessel according to the invention. In this embodiment the current lead-in wire is made of two limbs 3 and 4, is passed through different bores 6, 6' of the stopper 2 and is sealed by means of a vitreous enamel bond ensuring a hermetic seal. The two parts 3, 4 are stranded together externally of the stopper 2. To improve the malleability of the wire, it is made of niobium alloyed with 1% zirconium. Regarded electrically, the parts 3, 4 are connected in parallel. The stem 10 of electrode 8 is welded at 7 to the niobium lead-in wire. The permanently hermetic seal between the stopper 2 and the ceramic tube 1 made of alumina consists of a vitreous enamel bond 5. This design is in accordance with U.S. Pat. No. 4,376,905. In this embodiment the cavity 9, which is an important feature of the present invention, is formed as a blind hole worked into the stopper 2 essentially coaxially with the axis line of the tubular discharge vessel. According to our experience, if the cavity 9 were not present, then during operation of the discharge tube, when the metal additive(s) pass(es) into the molten phase, it or they would deposit or settle in the region of the internal face or rim of the stopper 2, in the region of its contact with the tube 1. This region is not only covered by vitreous enamel but is also highly exposed in the effect of heat from plasma radiation. The temperature inside the cavity 9 worked into the stopper 2, according to the invention, is lower than the temperature of the region mentioned above, therefore the cold spot will be formed inside the cavity 9 and the metal additives will condense inside the cavity 9. The volume of the cavity is chosen as to ensure that it is always larger than the volume of the liquid (molten) metal additive(s). Hence the cavity 9 is suitable for accommodating the quantity of additive(s) actually in molten phase. The melt in the cavity 9 is not in contact with the vitreous enamel and is shielded (shaded) from the heat transmitted by the plasma.

The electrodes 8 of the discharge vessel according to the invention, are generally made of tungsten (in some cases containing thoria) which are expediently coated with a suitable electron-emissive material. This construction is simple and well known, consequently the electrodes are illustrated merely schematically in the accompanying drawing.

Although it is scientifically not totally proven that the effect of the formation of a cold spot in the ceramic closing element, according to the invention, has been derived from the detrimental effects of the feedback mechanisms discussed in the introductory part of the present specification, it is a fact proven by the results of experiments that the application of discharge vessels provided with a cavity reduces by about 50% the relative scatter of the values of the initial ignition voltage and substantially eliminates the occurrence of lamps of substantially shorter life than the statistical average life.

The field of protection defined by the claims is not of course restricted to the preferred embodiment described and illustrated purely by way of example. The invention is applicable to any system of exhaust tubeless discharge vessels of high pressure sodium vapour lamps.

We claim:

1. A discharge vessel for high pressure sodium vapour lamps, the vessel having a tubular wall made of a light-transmitting material, ceramic closing elements for hermetically sealing the ends of the tube by means of a bond without the use of an exhaust tube, at least two current lead-in wires passing into the interior of discharge vessel through the ceramic closing elements, an electrode joined to each of the current lead-in wires, and a filling for the interior of the closed vessel containing at least one noble gas and at least one metallic additive, and a cavity formed in at least one of the ceramic closing elements, which cavity communicates with the interior of the hermetically sealed vessel and which during operation of the discharge vessel contains the spot or location of the lowest temperature of the internal surface of the wall bounding the interior of the discharge vessel, the volume of the cavity being at least equal to the volume of the metal additive filled into the discharge vessel when in the molten phase.

2. A discharge vessel according to claim 1 wherein the cavity is arranged symmetrically about the axis of the tube.

3. A discharge vessel according to claim 1 wherein the electrode is connected to the lead-in wire by way of a stem or shank.

4. A discharge vessel according to claim 1 wherein the metallic additive is selected from the group consisting of sodium, mercury, or cadmium.

5. A discharge vessel according to claim 4 wherein said clearance forms a cappillary aperture and the cavity communicates with the interior of the tube via the capillary aperture.

* * * * *